US005821972A

United States Patent [19]

Mey et al.

[11] Patent Number: 5,821,972

[45] Date of Patent: Oct. 13, 1998

[54] ELECTROGRAPHIC PRINTING APPARATUS AND METHOD

[75] Inventors: William Mey, Rochester; Thomas N. Tombs, Brockport; Thomas M. Stephany, Churchville; William Vreeland, Webster, all of N.Y.

[73] Assignee: Eastman Kodak Company, Rochester, N.Y.

[21] Appl. No.: 873,474

[22] Filed: Jun. 12, 1997

[51] Int. Cl.[6] ..... G03G 7/00

[52] U.S. Cl. ..... 347/153; 399/2

[58] Field of Search ..... 399/159, 162, 399/241, 2, 152; 347/153, 154; 430/31, 56

[56] References Cited

U.S. PATENT DOCUMENTS

| | | | |
|---|---|---|---|
| 4,757,332 | 7/1988 | Yuasa | 347/154 X |
| 5,084,735 | 1/1992 | Rimai et al. . | |
| 5,162,179 | 11/1992 | Lewicki, Jr. et al. | 347/153 X |
| 5,187,526 | 2/1993 | Zaretrsky . | |
| 5,214,239 | 5/1993 | Koga et al. . | |
| 5,324,885 | 6/1994 | Koga et al. . | |
| 5,370,961 | 12/1994 | Zaretsky et al. . | |
| 5,374,981 | 12/1994 | Yamamoto et al. . | |
| 5,424,815 | 6/1995 | Koga et al. . | |
| 5,477,006 | 12/1995 | Imamiya et al. . | |
| 5,561,510 | 10/1996 | Kamp et al. . | |

OTHER PUBLICATIONS

A. R. Kotz, "Magnetic Stylus Recording", 1981, *Journal of Applied Photographic Engineering*7:44–49.

*Primary Examiner*—S. Lee
*Attorney, Agent, or Firm*—Thomas H. Close

[57] ABSTRACT

Electrographic printing apparatus includes a developer supply for supplying a developer having a toner component; a print head for transferring toner from the developer supply in an image wise manner; and a compliant receiver for receiving the image wise toner from the print head. The receiver has a compliant inner conductive blanket layer for allowing the receiver to conform to a print medium and a non-compliant overcoat layer for efficiently releasing toner from the receiver. The image wise toner is transferred from the compliant receiver to the print medium at a transfer station.

16 Claims, 3 Drawing Sheets

ELECTROGRAPHIC PRINTING APPARATUS AND METHOD

CROSS-REFERENCE TO RELATED APPLICATIONS

Reference is made to U.S. Ser. No. 08/294,294, filed Aug. 23, 1994, entitled "Electrographic Printing Process and Apparatus" by William Mey et al.; U. S. Ser. No. 08/620,655, filed Mar. 22, 1996, entitled "Microchannel Print Head for Electrographic Printer" by William Grande, et al.; U.S. Ser. No. 08/811,750, filed Mar. 6, 1997, entitled "Electrographic Printer with Angled Print Head", by William Mey et al.; and to U.S. Ser. No. 08/843,688, filed Apr. 10, 1997, entitled "Electrographic Printer with Multiple Transfer Electrodes", by William Mey et al.

FIELD OF THE INVENTION

The invention relates generally to the field of printing, and in particular to electrographic printing methods and apparatus.

BACKGROUND OF THE INVENTION

An electrographic printing process wherein a magnetically responsive electrically conductive toner material is deposited directly on a dielectric receiver as a result of electronic current flow from an array of magnetically permeable styli into toner chains formed at the tips of the styli is disclosed in an article entitled "Magnetic Stylus Recording" by A. R. Kotz, Journal of Applied Photographic Engineering 7:44–49 (1981).

The toner material described by Kotz is a single-component, magnetically responsive, electrically conductive toner powder, as distinguished from multiple-component carrier/toner mixtures also used in electrophotographic development systems. The magnetically permeable styli described by Kotz are a linear array of magnetically permeable wires potted in a suitable material and arranged such that the ends of the wires are perpendicular to the receiver surface. A major advantage of this system is that it operates in response to relatively low voltage control signals (of the order of 10 volts), thereby allowing direct operation from inexpensive integrated circuits.

The dielectric receiver shown by Kotz is a dielectric layer on a hard drum. A problem with this configuration is that the receiver is not optimized for toner transfer, particularly if very small toner particles (e.g. less than 10 $\mu$m) are employed. To produce images with high resolution and high image quality, toner particles less than 10 $\mu$m in diameter are required. However, typical receivers have surface properties with surface irregularities larger than the diameters of the small toner particles, making transfer of the toner from the print head to the receiver difficult. Also the electrical properties (including resistivity and dielectric constant) of typical receivers, such as plain or treated paper can be non-uniform causing variations in toner transfer efficiency thereby degrading image quality.

U.S. Pat. No. 5,374,981 issued Dec. 20, 1994 to Yamamoto et al. shows an electrographic printer having a flexible receiver roller for maintaining a constant gap between flexible recording electrodes and the receiver electrode. While the flexible receiver roller described by Yamamoto et al. would improve the conformation of the receiver roller to a print medium having surface irregularities, the compliant materials (e.g. conductive urethane, nitrile, and silicone rubbers) employed by Yamamoto et al. are sticky and do not readily release toner, thereby degrading image quality.

There is a need therefore for an electrographic printing method and apparatus having improved toner transfer.

SUMMARY OF THE INVENTION

The present invention is directed to overcoming one or more of the problems set forth above. Briefly summarized, electrographic printing apparatus according to the present invention includes a developer supply for supplying a developer having a toner component; a print head for transferring toner from the developer supply in an image wise manner; and a compliant receiver for receiving the image wise toner from the print head. The receiver has a compliant inner conductive blanket layer for allowing the receiver to conform to a print medium and a flexible noncompliant overcoat layer for efficiently releasing toner from the receiver. The image wise toner is transferred from the compliant receiver to the print medium at a transfer station.

These and other aspects, objects, features and advantages of the present invention will be more clearly understood and appreciated from a review of the following detailed description of the preferred embodiments and appended claims, and by reference to the accompanying drawings.

ADVANTAGEOUS EFFECT OF THE INVENTION

The present invention is advantageous in that the use of a compliant receiver having a thin noncompliant surface layer as an imaging member of an electrographic printer enables the efficient transfer of very small toner particles which improves image quality by improving writing efficiency and toner transfer efficiency. In addition, there is a concomitant improvement in resolution, sharpness, and granularity. Another advantage is that the receiver according to the present invention facilitates transfer to a variety of print media.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
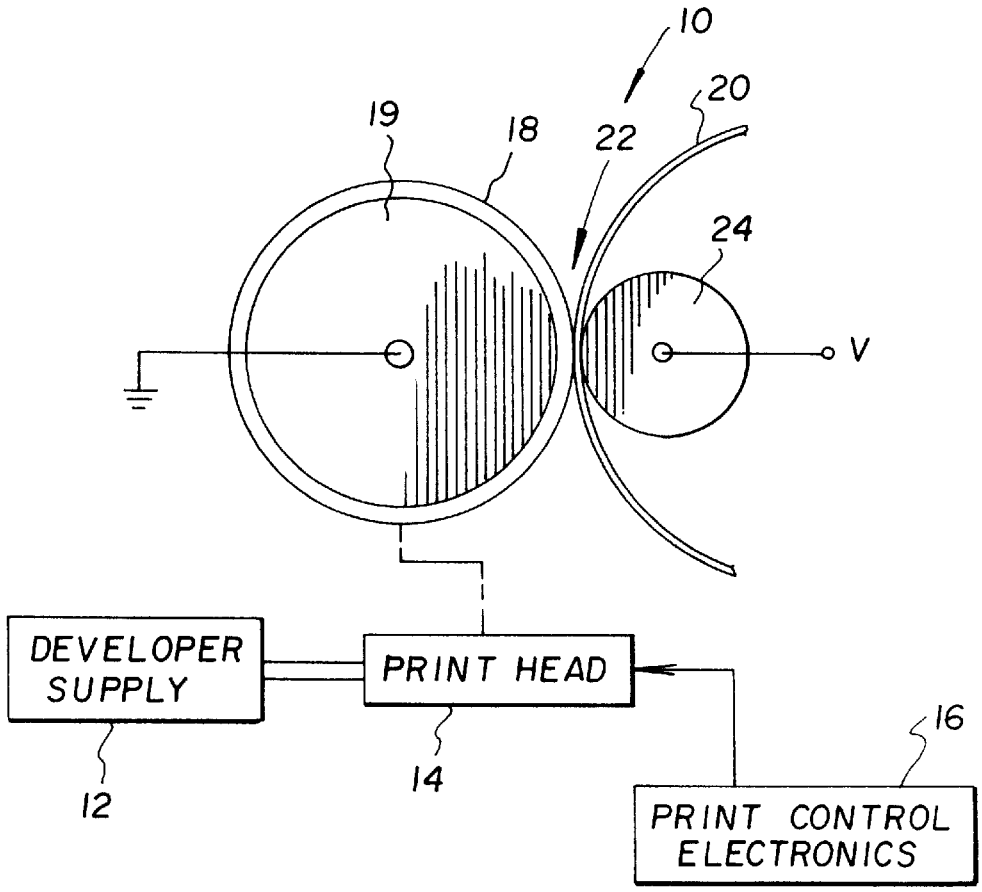
FIG. 1 is a schematic diagram of an electrographic printing apparatus according to the present invention.

Referring now to FIG. 1, an electrographic printing apparatus according to the present invention is shown. The apparatus, generally designated 10 includes a developer supply 12 containing an electrographic developer, having a toner component, that is supplied to a print head 14. The electrographic developer may be supplied to the print head 14, for example by a magnetic brush (not shown). The print head 14 transfers toner from the developer in an imagewise manner under the control of print control electronics 16 to a compliant receiver 18. The compliant receiver 18 carried on an electrically conductive drum 19 that is biased to facilitate transfer of the toner to the compliant receiver 18. The imagewise toner is then transferred to a print medium 20 at a transfer location 22. A conductive transfer roller 24, biased to transfer voltage V, is provided at the transfer location 22.

The compliant receiver 18 according to the present invention can be utilized in any electrographic printing apparatus that transfers toner from a printhead to a receiver. This includes methods using an aperture array, thermal writing techniques, or any of the numerous techniques for direct imagewise deposition of toner onto a receiver. The use of the compliant receiver 18 improves overall image quality since it can be optimized for the effective imagewise transfer of toner at the print head 14.

Figure 2:
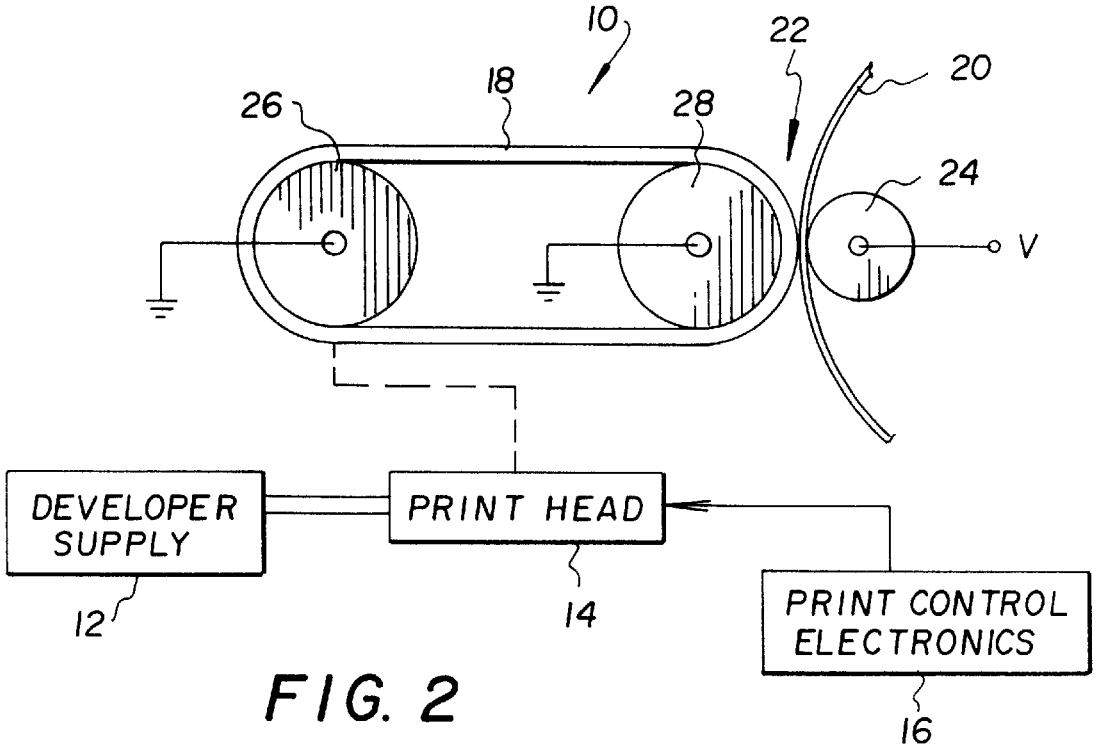
FIG. 2 is a schematic diagram of an alternative embodiment of electrographic printing apparatus according to the present invention.

Referring to FIG. 2, an alternative embodiment of the electrographic apparatus is shown wherein the compliant receiver is in the form of a web carried by a pair of rollers 26 and 28. Roller 26 is conductive and biased to facilitate toner transfer from the printhead 14 to the compliant web 18. Roller 28 is electrically conductive and biased to facilitate transfer of the toner to the print media 20.

Figure 3:
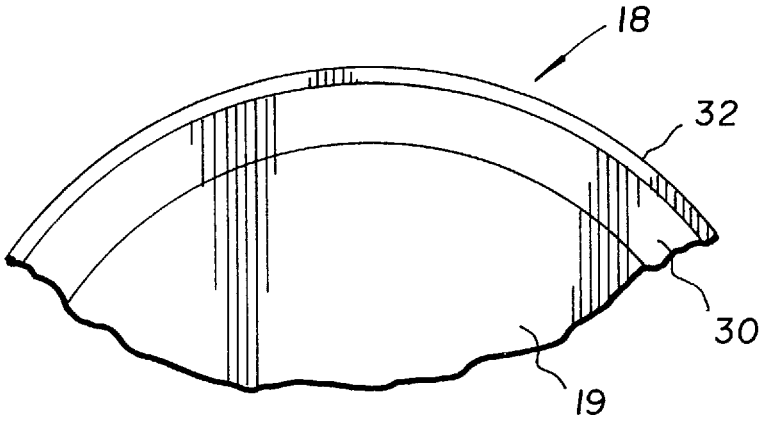
FIG. 3 is partial end view showing one configuration of the compliant intermediate roller used in an electrographic printer of the present invention

Referring to FIG. 3, according to a preferred embodiment of the present invention, the compliant receiver 18 includes a compliant blanket layer 30 and a thin overcoat layer 32. The compliant blanket layer 30 is soft enough to conform to the surface roughness of a wide variety of print media 20, thereby improving toner transfer. The thin overcoat layer 32 provides a smooth hard surface and uniform electrical properties necessary for the transfer of toner from the print head 14 to the compliant receiver 18. In addition, the overcoat layer facilitates efficient toner transfer to the print media 20.

The blanket layer 30 is between 0.5 mm and 30 mm thick, and preferably between 2 mm and 10 mm. Its Young's Modulus should be less than 10 MPa and preferably between 0.5 MPa and 5 MPa. The resistivity of the blanket layer should be less than $10^9$ ohms-cm preferable less than $10^7$ ohms-cm. Suitable materials for this blanket layer are polyurethanes, silicone rubbers, and silicone foams. Properties of the overcoat layer 32 arc a thickness less than 100 $\mu$m and preferably between 5 and 30 $\mu$m with a Young's Modulus greater than 100 MPa. Its resistivity should be greater than $10^{10}$ ohms-cm. Suitable materials include fluoropolymers, sol-gels, ceramers, and polycarbonates. Preferably this overcoat layer is made of materials having a low force of adhesion to the toner.

A compliant receiver according to the present invention was constructed by providing a cylindrical aluminum drum 9.5 cm diameter, and 7 cm inches long. A compliant blanket layer of 6 mm thick polyurethane doped with ferric chloride antistat so that the bulk electrical resistivity was $2\times10^8$ ohm-cm, and having a Young's Modulus of 4.83 MPa was cast on the core. The blanket layer was then cured in an oven at 150° C. for 8 hours. After curing, the blanket layer was ground to a final outer dimension of 10 cm, using a lathe. An overcoat layer of 5 micron thick ceramer was applied to the outer surface of the blanket layer by solvent coating using a ring coating technique. The ceramer overcoat had a Young's Modulus of 1.5 Gpa, and a bulk resistivity of approximately $10^{12}$ ohm-cm.

Alternatively, the conductive compliant blanket layer 30 may be provided by a compliant blanket layer and a thin (e.g. less than 1 micron) conductive coating, such as nickel or a conductive polymer on the compliant blanket layer, between the blanket layer 30 and the overcoat layer 32. This conductive layer is electrically biased for example by electrically contacting it at the edge of the drum 19. One advantage of this arrangement is that the electrical properties of the compliant blanket layer are not important, thereby providing a greater choice of materials for the blanket layer.

Figure 4:
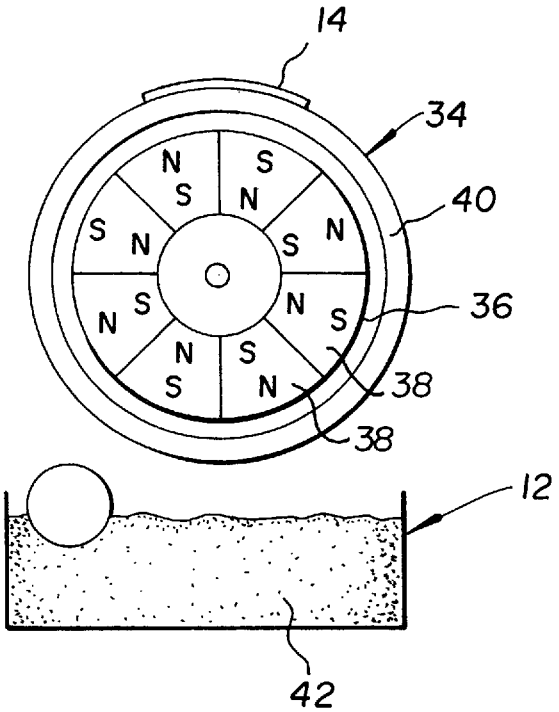
FIG. 4 is a schematic view of the print head mounted on a magnetic brush and an associated developer supply.

FIG. 4 shows a print head 14 mounted on a magnetic brush 34. The magnetic brush 34 includes a cylindrical magnet 36 having a plurality of alternately poled magnetic sectors 38. The cylindrical magnet 36 is surrounded by a stationary shell 40, and the cylindrical magnet is mounted for rotation inside the shell 40. The rotation of magnet 36 is effective to transport magnetic developer 42 from developer supply 12 to print head 14 in a known manner.

Figure 5:
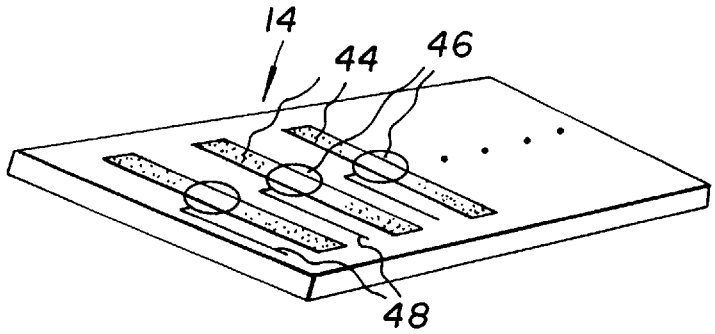
FIG. 5 is perspective view of a magnetic stripe print head useful with the present invention.

FIG. 5 is a partial top view of a magnetic stripe print head 14 useful with the present invention. The print head 14 includes a plurality of magnetic stripes 44 which are effective to form lines of magnetic developer on the print head. A plurality of transfer electrodes 46 are individually addressable via electrical conductors 48 to transfer toner from the lines of developer to the compliant receiver.

Figure 6:
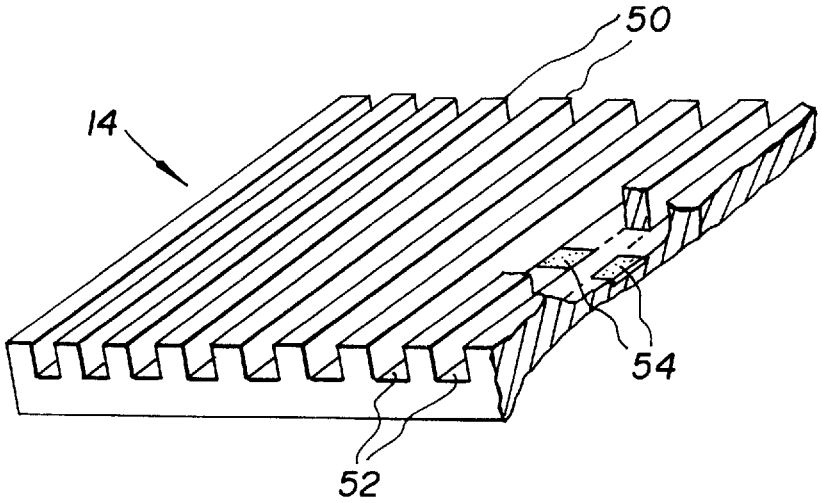
FIG. 6 is a perspective view of a microchannel print head useful with the present invention.

FIG. 6 is a partial top view of a microchannel print head 14 useful with the present invention. The print head 14 has a plurality of walls 50 which define a plurality of microchannels 52. Developer particles are caused to travel down the microchannels by the magnetic brush 34. An electrically conducting transfer electrode 54 is located in each of the microchannels 52 for transferring toner from magnetic developer in the channels. The microchannels can be fabricated on flex material, such as on flex circuit using photoresist to form the channels, or on non-flexible material such as silicon. The microchannel printhead 14 can be formed, for example, by forming the transfer electrodes 54 and conductors (not shown) leading to the transfer electrodes on the surface of the nonflexible material and then applying a photo-imageable polymer to the surface of the non-flexible material and patterning the photo-imageable polymer to form the walls of the channels. The conductors leading to the transfer electrodes may be positioned under the channel walls using this technique. Alternatively, the walls may be formed in the surface by cutting, such as by using a diamond saw, or other micromachining techniques known in the art such as wet etching, dry etching, ion milling, laser ablation, and laser cutting. With this approach, the conductors leading to the transfer electrodes may be formed on the back side of the print head and electrical connection made with the transfer electrodes via plated through holes. The microchannels may be machined in any material such as that used as the stationary shell of the magnetic brush. The channel wall height is selected to accommodate the nap height of the developer chains, which depends in turn upon the particular developer and strength of the magnets in the magnetic brush, or upon the height of a leveling skive used to level the developer upon entry into the channels.

The channel width and wall thickness need not have the same dimensions. The wall thickness can be altered, independently from the channel width, to accommodate the desired printer resolution. The walls 40 may be provided with an anti-static layer such as indium tin oxide or doped polysilicon to prevent static build-up on the developer particles due to the developer rubbing against the channel walls as it moves through the channels.

Returning to FIG. 1, toner transfer from the compliant intermediate image forming member to paper can be accomplished either electrostatically or thermally. Both methods are well known in the art.

Color imaging can be provided with the present invention by either transferring each color component to a single compliant receiver, or by providing a separate compliant receiver for each color.

The invention has been described with reference to a preferred embodiment. However, it will be appreciated that variations and modifications can be effected by a person of ordinary skill in the art without departing from the scope of the invention.

PARTS LIST

10 electrographic printing apparatus
12 developer supply
14 print head
16 print control electronics
18 compliant receiver
19 electrically conductive drum
20 print medium
22 transfer location
24 transfer roller
26 electrically conductive roller
28 electrically conductive roller
30 compliant blanket layer
32 overcoat layer
34 magnetic brush
36 cylindrical magnet
38 magnetic sectors
40 stationary shell
42 magnetic developer
44 magnetic stripes
46 transfer electrodes
48 electrical conductors
50 microchannel walls
52 microchannels
54 transfer electrode

We claim:

1. Electrographic printing apparatus, comprising;

a) a developer supply for supplying a developer having a toner component;

b) a print head for transferring toner from the developer supply in an image wise manner;

c) a compliant receiver for receiving the image wise toner from the print head, the receiver having a compliant inner conductive blanket layer for allowing the receiver to conform to a print medium and a flexible non compliant overcoat layer for efficiently releasing toner from the receiver; and d) means for transferring the image wise toner from the compliant receiver to the print medium.

2. The electrographic printing apparatus claimed in claim 1, wherein the compliant receiver is a roller.

3. The electrographic printing apparatus claimed in claim 1, wherein the compliant receiver is a belt.

4. The electrographic printing apparatus claimed in claim 2, wherein:

a) the compliant inner conductive blanket layer having a Young's Modulus less than 10 mega Pascals and between 0.5 and 30 mm thick, and a resistivity of less than $10^9$ ohms-cm; and b) the flexible non compliant overcoat layer having a Young's Modulus greater that 100 mega Pascals, a thickness of less than 100 $\mu$m and resistivity greater than $10^{10}$ ohms-cm.

5. The electrographic printing apparatus claimed in claim 4, wherein the compliant inner conductive blanket layer is a material selected from the group comprising polyurethane, silicone rubber, silicone foam, and polyurethane foam; and the flexible non compliant overcoat layer is a material selected from the group comprising fluoropolymers, polyurethane, sol-gel, polycarbonate, diamond-like carbon, and ceramer.

6. The electrographic printing apparatus claimed in claim 4, wherein the compliant inner conductive blanket layer is polyurethane and the flexible non compliant overcoat layer is ceramer.

7. The electrographic printing apparatus claimed in claim 1, wherein the developer includes a magnetic component, further comprising:

e) a magnetic brush for delivering developer to the print head, and wherein the print head includes electrodes for transferring toner from the developer supply to the compliant receiver.

8. The electrographic printing apparatus claimed in claim 7, wherein the print head further includes means for forming lines of developer, and wherein the toner is transferred from the lines of developer.

9. The electrographic printing apparatus claimed in claim 8, wherein the means for forming lines of developer is a plurality of strips of magnetic material.

10. The electrographic printing apparatus claimed in claim 8, wherein the means for forming lines of developer is a plurality of microgrooves.

11. The electrographic printing apparatus claimed in claim 1, wherein the print head includes an array of apertures and means for electrically gating toner through the apertures.

12. A method of electrographic printing, comprising the steps of;

a) supplying a developer having a toner component to a print head;

b) transferring toner from the print head to a compliant receiver in an image wise manner, the receiver having a compliant inner conductive blanket layer for allowing the receiver to conform to a print medium and a flexible non compliant overcoat layer for efficiently releasing toner from the receiver; and c) transferring the image wise toner from the compliant receiver to a print medium.

13. The method claimed in claim 12, wherein the inner conductive compliant blanket layer has a Young's Modulus between 0.1 and 10 mega Pascals, and the flexible non compliant overcoat layer has a Young's Modulus of greater than 100 mega Pascals and a thickness of less than 100 $\mu$m.

14. The method claimed in claim 13, wherein the compliant receiver is a roller.

15. The method claimed in claim 13, wherein the compliant receiver is a web.

16. The electrographic printing apparatus claimed in claim 1, wherein the compliant inner conductive blanket layer comprises a compliant layer and a conductive coating having a thickness less than 1 micron on the compliant inner conductive blanket layer.

* * * * *